US006525005B1

(12) United States Patent
Kravitz et al.

(10) Patent No.: US 6,525,005 B1
(45) Date of Patent: Feb. 25, 2003

(54) ANTIMICROBIAL CONVEYOR LUBRICANT COMPOSITION AND METHOD FOR USING

(75) Inventors: Joseph I. Kravitz, Champlin; Joy G. Herdt, New Port, both of MN (US); Kimberly L. Person Hei, Baldwin, WI (US); Michael E. Besse, Golden Valley, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/580,464

(22) Filed: May 26, 2000

Related U.S. Application Data

(63) Continuation-in-part of application No. 09/231,255, filed on Jan. 15, 1999.

(51) Int. Cl.[7] ..... C10M 133/04; C10M 137/04

(52) U.S. Cl. ..... 508/438; 508/501; 508/547; 508/577

(58) Field of Search ..... 508/438, 501, 508/547, 577

(56) References Cited

U.S. PATENT DOCUMENTS

| | | | |
|---|---|---|---|
| 2,779,740 | A | 1/1957 | Messina et al. |
| 3,382,032 | A | 5/1968 | Cox |
| 3,645,897 | A | 2/1972 | Gower et al. |
| 3,718,588 | A | 2/1973 | Bellos et al. |
| 3,860,521 | A | 1/1975 | Aepli et al. |
| 4,384,965 | A | 5/1983 | Hellsten et al. |
| 4,419,253 | A | 12/1983 | Kennedy et al. |
| 4,521,321 | A | 6/1985 | Anderson et al. |
| 4,557,848 | A | 12/1985 | Sung et al. |
| 4,604,220 | A | 8/1986 | Stanton |
| 4,624,793 | A | 11/1986 | Phifer et al. |
| 4,636,321 | A | 1/1987 | Kipp et al. |
| 4,758,359 | A | 7/1988 | Kirk et al. |
| 4,839,067 | A | 6/1989 | Jansen |
| 5,062,979 | A | 11/1991 | Scharf et al. |
| 5,073,280 | A | 12/1991 | Rossio et al. |
| 5,190,679 | A | 3/1993 | McDonald |

(List continued on next page.)

FOREIGN PATENT DOCUMENTS

| | | | |
|---|---|---|---|
| FR | 053352 | | 3/1993 |
| JP | 2097592 | | 2/1992 |
| JP | 2097593 | | 2/1992 |
| JP | 07 34079 | | 2/1995 |
| JP | 08333592 | | 12/1996 |
| WO | WO 95/34694 | | 12/1995 |
| WO | 9602616 | * | 2/1996 |
| WO | 9720903 | * | 6/1997 |

OTHER PUBLICATIONS

"Anionics GAFAC Surfactants", *Rhone–Poulenc Catalog of Surfactants & Specialties*pp. 5–7 (1993).
"Carbonated Beverages", *Encyclopedia of Chemical Technology*, $_{5.}$, 4th Edition, John Wiley & Sons Pub., pp. 2627.
"EMPHOS Organic Phosphate Esters", *Witco Chemical: Organics Division, Bulletin*$_{234}$, Witco Chemical: Organics Division, 1,2,4,6,8 (Nov. 1977).

*Primary Examiner*—Margaret Medley
*Assistant Examiner*—Cephia D. Toomer
(74) *Attorney, Agent, or Firm*—Merchant & Gould P.C.

(57) ABSTRACT

Lubricant compositions are used on conveying systems in the beverage industry during the filling of containers with dairy products or other beverages. An antimicrobial conveyor lubricant composition according to the invention includes alkyl alkoxylated phosphate ester, antimicrobial agent comprising at least one of quaternary ammonium antimicrobial agent and protonated amine antimicrobial agent, extreme pressure additive, water, and neutralizing agent in an amount sufficient to provide a use solution having a pH in the range of about 4 to about 9. The composition can include an extreme pressure additive and/or a corrosion inhibitor. A method for using an antimicrobial lubricant composition is provided.

34 Claims, 4 Drawing Sheets

U.S. PATENT DOCUMENTS 5,223,162 A 6/1993 Rossio
5,244,589 A 9/1993 Liu et al.
5,182,035 A 12/1993 Schmidt et al.
5,282,992 A 2/1994 Reichgott
5,352,376 A 10/1994 Gutzmann
5,391,308 A 2/1995 Despo
5,407,700 A 4/1995 Man et al.
5,409,713 A 4/1995 Lokkesmoe et al.
5,419,908 A 5/1995 Richter et al.
5,436,008 A 7/1995 Richter et al.
5,437,868 A 8/1995 Oakes et al.
5,441,654 A 8/1995 Rossio
5,462,681 A 10/1995 Gutzmann et al.
5,489,434 A 2/1996 Oakes et al.
5,510,045 A 4/1996 Remus
5,667,349 A 9/1997 Turchin et al.
5,723,418 A * 3/1998 Person Hei et al. ..... 508/511
5,925,601 A * 9/1999 McSherry et al. ..... 508/425

* cited by examiner

ANTIMICROBIAL CONVEYOR LUBRICANT COMPOSITION AND METHOD FOR USING

This application is a continuation-in-part of U.S. patent application Ser. No. 09/231,255 that was filed with the United States Patent and Trademark Office on Jan. 15, 1999. The entire disclosure of U.S. application Ser. No. 09/231,255 is incorporated herein by reference.

FIELD OF THE INVENTION

The present invention relates to an antimicrobial conveyor lubricant composition and to a method for using an antimicrobial conveyor lubricant composition.

BACKGROUND OF THE INVENTION

In the commercial distribution of most beverages, the beverages are packaged in containers of varying sizes, such containers being in the form of cartons, cans, bottles, tetrapack packages, waxed carton packs, and other forms of containers. In most packaging operations, the containers are moved along conveying systems, usually in an upright position (with the opening of the container facing vertically up or down), and moved from station to station, where various operations are performed (e.g., filling, capping, labeling, sealing, etc.). The containers, in addition to their many possible formats and constructions, may comprise many different types of materials, such as metals, glasses, ceramics, papers, treated papers, waxed papers, composites, layered structures, and polymeric materials (e.g., especially polyolefins such as polyethylene, polypropylene, polystyrene, blends and laminates thereof, polyesters such as polyethyleneterephthalate and polyethylenenaphthalate, blends, and laminates thereof, polyamides, polycarbonates, etc.).

There are a number of different requirements that are essential or desirable for antimicrobial lubricants in the conveying systems used to carry containers for beverages. The essential requirements are that the materials provide an acceptable level of lubricity for the system and that the lubricant displays an acceptable antimicrobial activity. It is also desirable that the lubricant has a viscosity which allows it to be applied by conventional pumping and/or application apparatus (e.g., spraying, roller coating, wet bed coating, etc.) as commonly used in the beverage conveyor lubricating art, and that the lubricant is beverage compatible so that it does not form solid deposits when it accidentally contacts spilled beverage on the conveyor system. This last requirement can be especially important since the formation of deposits on the conveyor will change the lubricity of the system and could require shut-down of the equipment to facilitate cleaning. Deposits may occur from the combination of beverage and lubricant in a number of different chemical methods, depending upon the particular beverage and lubricant used. One of the more common forms of deposit is caused by the formation of micelles or coacervates from the interaction of species, especially different ionic species within the two materials.

Different types of lubricants have been used in the beverage conveying industry with varying degrees of success. A more common type of lubricant is the fatty acid lubricant (either the acid itself or amine salt and/or alkali metal salts and/or ester derivatives thereof), some of which are described in U.S. Pat. No. 5,391,308. Another type of lubricant used within this field is the organic phosphate ester, as shown in U.S. Pat. No. 4,521,321 and PCT Application WO 96/02616, based upon British Patent Application 94/14442.5 filed Jul. 18, 1994 (PCT/GB95/01641).

U.S. Pat. No. 5,391,308 discloses phosphate esters other than alkyl or linear esters (e.g., the alkyl aryl phosphate esters described on column 6, lines 11–20 used in combination with the alkyl or linear phosphate esters). The lubricant system of this patent also requires the use of an aqueous based long chain fatty acid composition at a pH of from 9.0 to 10.5 as the lubricant, with specifically combined ingredients to avoid stress cracking in polyethylene terephthalate (PET) bottles transported on a conveyor system. The aromatic-polyoxyalkyl esters are specifically disclosed as part of a combination of esters (along with the alkyl esters) which > ". . . results in substantial reduction in stress cracking, thus fuinctioning as the stress cracking inhibiting agent, as well as the emulsifying agent, in the aqueous lubricant concentrate."

See U.S. Patent No. 5,391,308 at column 3, lines 48–52. The reference is specific to fatty acid lubricants, and the specification points out that the use of potassium hydroxide as the saponifying agent, in fatty acid lubricants, has been found to contribute to and to promote stress cracking in PET (polyethylene terephthalate) bottles. A blend of alkyl phosphate esters and aromatic phosphate esters are shown in combination with the fatty acid lubricant to reduce stress cracking.

PCT Application WO 96/02616 describes the use of lubricant concentrates comprising organic alkyl phosphate esters, aromatic biocidal quaternary ammonium compounds, and sufficient base to provide the concentrate with a pH of from 5 to 10.

U.S. Pat. No. 4,521,321 describes lubricants for conveyor systems that comprise dilute aqueous systems of partially neutralized monophosphate aliphatic (e.g., saturated or partially unsaturated linear alkyl). The use of a synergist such as long chain fatty alcohol, fatty acid derived amine oxide, or urea improves the properties of the lubricant.

U.S. Pat. No. 5,062,979 describes lubricants for conveyor systems comprising aqueous, clear solution-forming, substantially soap-free compositions. These lubricants comprise pH 6–8 compositions comprising alkyl benzene sulfonates, partial phosphate esters with alkoxylated aliphatic alcohols, and aliphatic carboxylic acids. Typical additives such as solubilizers, solvents, foam inhibitors and disinfectants may also be present. The aliphatic carboxylic acids are C6-C 12 fatty acids.

U.S. patent application U.S. Ser. No. 09/002,796, titled "ANTIMICROBIAL, BEVERAGE COMPATIBLE" and filed on Jan. 5, 1998 describes lubricating compositions, especially designed for use in beverage conveying systems for contained beverages. The lubricating compositions can include:

a) an alkyl alkoxylated (e.g., ethoxylated or propoxylated, preferably ethoxylated) phosphate ester, b) aryl (e.g., aromatic, such as phenol) alkoxylated (e.g., ethoxylated or propoxylated) phosphate ester, c) an aromatic or linear quaternary ammonium antimicrobial agent, and d) a liquid carrier, such as water.

Particularly desirable optional agents include chelating agents (e.g., the aminoacetic acid chelating agents such as ethylene diamine tetraacetic acid, EDTA), detergents (e.g., nonionic surfactants) and pH control agents (e.g, potassium or sodium hydroxide).

SUMMARY OF THE INVENTION

An antimicrobial conveyor lubricant composition is provided according to the invention. The antimicrobial conveyor lubricant composition includes an alkyl alkoxylated phosphate ester, an antimicrobial agent, water, and neutralizing agent in an amount sufficient to provide an antimicrobial lubricant composition use solution with a pH in the range of about 4 to about 9. The lubricant composition can preferably be characterized as a non-fatty acid lubricant based antimicrobial conveyor lubricant composition. The lubricant composition can additionally include extreme pressure additive, corrosion inhibitor, and viscosity control agent. Preferred viscosity control agents include secondary alcohol alkoxylates, aromatic alkoxylated phosphate esters, and mixtures thereof.

A method for using an antimicrobial conveyor lubricant composition is provided according to the invention. The method includes a step of applying the antimicrobial conveyor lubricant composition use solution to a conveyor. In general, the antimicrobial conveyor lubricant composition use solution is prepared by diluting an antimicrobial conveyor lubricant composition concentrate with water to provide a use solution having an active level of between about 0.1% and 1%.

DETAILED DESCRIPTION OF THE INVENTION

Figure 1:
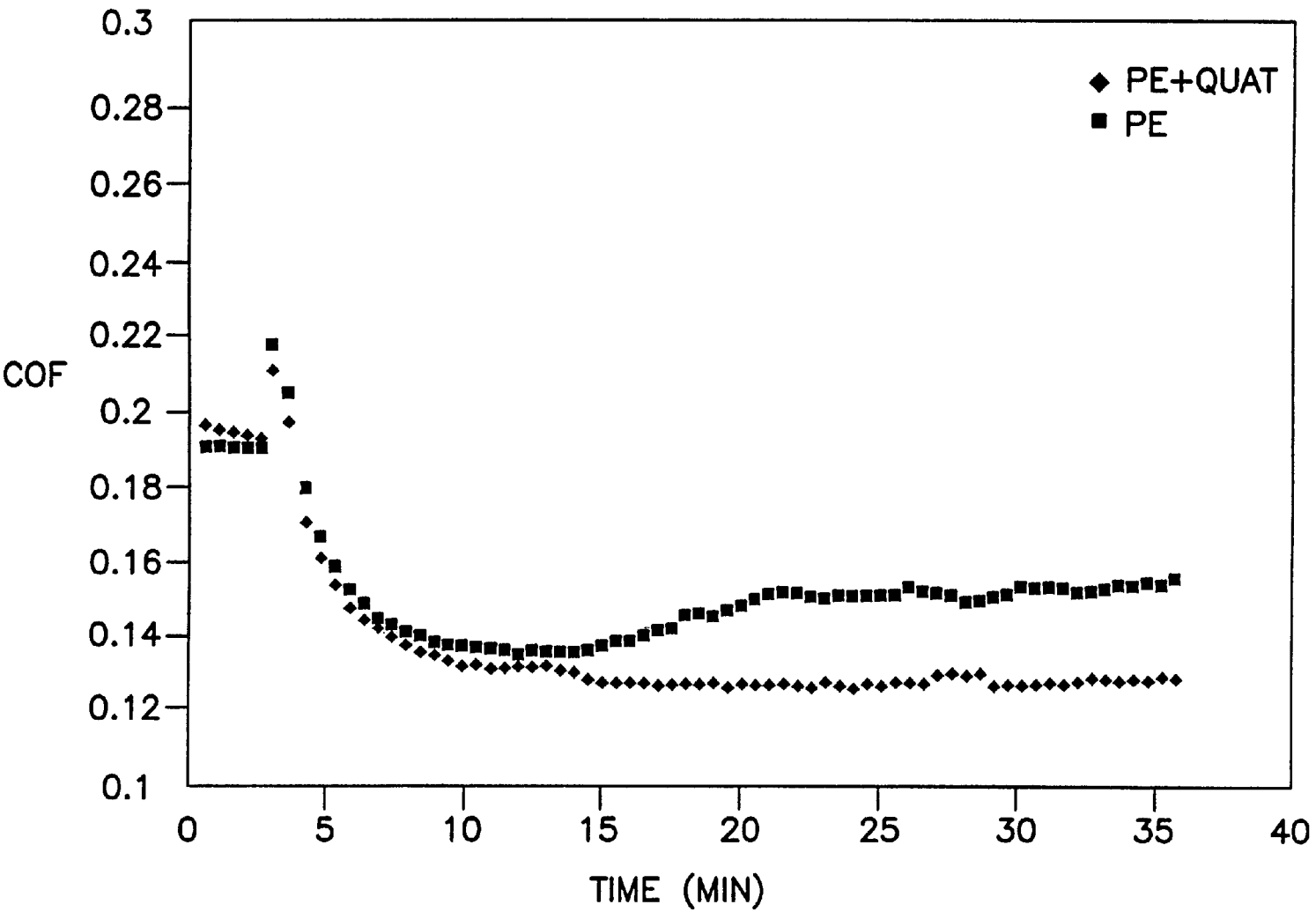
FIG. 1 shows a graph of data relating the kinetic Coefficient of Friction (kinetic COF) for phosphate esters alone, versus phosphate esters mixed with quaternary ammonium biocides.

The antimicrobial conveyor lubricant compositions according to the invention can be referred to more simply as the lubricant composition or as the lubricant. The lubricant composition according to the invention includes an alkyl alkoxylated phosphate ester, an antimicrobial agent, water, and a sufficient amount of neutralizing agent to provide a use solution of the lubricant composition with a pH in the range of about 4 to about 9. Preferably, the lubricant composition additionally includes an extreme pressure additive, and/or a corrosion inhibitor. The lubricant composition can additionally include a viscosity control agent. Preferred viscosity control agents include secondary alcohol alkoxylates and aromatic alkoxylated phosphate esters.

The lubricating composition according to the invention can be provided as a concentrate or as a use solution. The concentrate can be diluted with the appropriate liquid (e.g., usually water) to up to a 400 times dilution to provide a use solution of the lubricant composition. It should be appreciated that the reference to "lubricant composition" is a reference to the lubricant composition in the form of a concentrate and/or use solution. The lubricant compositions according to the invention can provide beneficial properties as a lubricant use solution, and especially as a lubricant use solution for conveying systems for beverage containers, including dairy containers. The components and properties sought for the lubricant compositions are described below.

The use solution is preferably characterized as having an active level of between about 0.1 wt. % and about 1 wt. %. The term "active level" is meant to characterize the non-diluent portion of the use solution. For example, for a use solution having an active level of 1 wt. %, it is expected that 99 wt. % of the use solution is water. Preferably, the active level of the use solution is between about 0.25 wt. % and about 0.50 wt. %. It is expected that in most applications, the use solution will be prepared by diluting a concentrate.

The alkyl alkoxylated phosphate ester is preferably an ethoxylated and/or propoxylated phosphate ester having the general structural formula:

$$R^1—O—(R^2O)_n—PO_3X_2$$

wherein $R^1$ comprises an alkyl group (e.g., linear, branched or cyclic alkyl group) of from 1 to 20 carbon atoms, preferably of from 8 to 12 carbon atoms, $R^2$ is selected from $—CH_2—CH_2—$ and

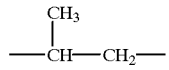

(ethylene and propylene)

n is 3 to 8 when $R^2$ is propylene, and 3 to 10 when $R^2$ is ethylene, and

X is hydrogen, alkanolamine and/or alkali metal.

The alkyl groups of $R^1$ may be variously substituted so as to provide a variety of subtle changes in its physical properties, especially with respect to its solubility (e.g., the addition of solubilizing groups or pH adjusting groups) and ionic qualities. Where the phosphate ester comprises an ethoxylated phosphate ester structure, another representative formula would be:

$$R^1—O—((CH_2)_2—O)n—PO_3X_2$$

wherein $R^1$ comprises an alkyl group (e.g., linear, branched or cyclic alkyl group of from 1 to 20 carbon atoms, preferably of from 8 to 12 or 10 to 12 carbon atoms), n is 3 to 8 or 3 to 10, preferably from 4 to 6 with a weight average of about 5, and X is hydrogen, alkanolamine and/or alkali metal.

Alkyl phosphate esters are available commercially under the names: Rhodafac (i.e., Rhodafac PC-100, Rhodafac PL-620, Rhodafac PL-6, and Rhodafac RA-600) from Rhodia, Inc. of Cranberry, N.J.; Emphos (Emphos PS-236) from Witco Corporation of Greenwich, Connecticut; DePhos (i.e., DePhos RA-40, DePhos RA-60, DePhos RA-75, DePhos RA-80); and Ethfac (i.e., Ethfac 141, Ethfac 161, Ethfac 104, Ethfac 106, Ethfac 136, and Ethfac 124) of Ethox Chemicals, LLC of Greenville, S.C.

The concentrate preferably includes a sufficient lubricating amount of alkyl phosphate ester to provide the use solution with a desired lubricity. The amount of alkyl alkoxylated phosphate ester provided is sufficient to provide a desired level of lubricity. Too much alky alkoxylated phosphate ester increases viscosity and expense. In addition, the ratio of anionic and cationic species present in the lubricant composition should be sufficient to avoid phase separation. Accordingly, too little or too much alky alkoxylated phosphate ester relative to the other components can result in phase separation. The alkyl phosphate ester is preferably provided in the concentrate in an amount of between about 1 wt. % and about 20 wt. %, more preferably between about 3 wt. % and about 15 wt. %, and, even more preferably, between about 7 wt. % and about 13 wt. %.

The lubricant composition can include a viscosity control agent for controlling viscosity. An exemplary viscosity control agent includes an aromatic alkoxylated phosphate ester such as those disclosed in U.S. application Ser. No. 09/227,593 that was filed with the United States Patent and Trademark Office on Jan. 8, 1999. The entire disclosure of U.S. application Ser. No. 09/227,593 is incorporated herein by reference. In particular, the portion of U.S. application Ser. No. 09/227,593 relating to the use of an aromatic alkoxylated phosphate ester in an antimicrobial conveyor lubricant composition is incorporated herein by reference.

In general, it is expected that the aliphatic phosphate esters provide better lubricity than the aromatic phosphate esters. The Applicants discovered that viscosity control could be provided by including aromatic phosphate ester in the lubricant composition in addition to the aliphatic phosphate ester. In addition, the aromatic phosphate ester provides enhanced temperature stability.

An aromatic (e.g., aryl, phenol, naphthol, etc.) alkoxylated (e.g., ethoxylated and/or propoxylated) phosphate ester has the general formula of:

$$R^2R^3C_6H_3—O—(R^4O)n—PO_3X_2$$

wherein $R^2$ and $R^3$ may be independently selected from the group consisting of hydrogen and alkyl group (e.g., linear, branched or cyclic alkyl group of from 1 to 20 carbon atoms, preferably of from 8 to 12 carbon atoms), $R^4$ is selected from $—CH_2CH_2—$ and

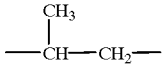

(ethylene and propylene), n is 3 to 5 when $R^4$ is propylene and is 3–15 when $R^4$ is ethylene, and X is hydrogen, alkanolamine and/or alkali metal.

Again, alkyl groups of $R^2$ and $R^3$ may be variously substituted so as to provide a variety of subtle changes in its physical properties, especially with respect to its solubility (e.g., the addition of solubilizing groups or pH adjusting groups) and ionic qualities. Preferably, $R^2$ and $R^3$ are hydrogen.

The aromatic alkoxylated phosphate esters may also be found commercially, particularly in the materials available under the name Rhodafac from Rhone-Poulenc (e.g., Rhodafac RE-410, RE-610, RE-960, RM-410, RM-510, RP-710, RM-710, BP-769 alkylphenol ethoxylates (especially nonylphenol ethoxylates) and the like. The aromatic phosphate esters are also commercially available, as for example as DePhos PE-481, PE- 786, RA-831 aromatic phosphate esters (from DeForest Enterprises), and Chemfac NB-0141T, NC-004K, NB 0141T, PB-082K and PN-322 aromatic phosphate esters from Chemax, Inc.

The aromatic alkoxylated phosphate ester need not be incorporated into the lubricant composition according to the invention. When the aromatic alkoxylated phosphate ester is incorporated into the lubricant composition according to the invention, it is preferably included in an amount that provides for viscosity control and/or temperature stability. In general, too much aromatic alkoxylated phosphate ester is expected to adversely effect lubricity. Preferably, the amount of aromatic alkoxylated phosphate ester provided in the concentrate is an amount of between about 0.25 wt. % and about 4 wt. %, more preferably between about 1 wt. % and about 3 wt. %, and, even more preferably, between about 1.5 wt. % and about 2.5 wt. %.

The antimicrobial agent is preferably a cationic agent that provides antimicrobial properties when provided in the lubricant composition. The antimicrobial agent is preferably either an aromatic quaternary ammonium antimicrobial agent or a linear quaternary ammonium antimicrobial agent. Aromatic and linear quaternary ammonium antimicrobial agents are generally known in the antimicrobial art. These are preferred over the phenolic antimicrobials, particularly the chlorinated phenols that are found in the state of the art and fatty acid lubricants, because it is believed the aromatic and/or linear antimicrobial agents work synergistically with the alkyl alkoxylated phosphate ester to improve lubricity, and they are more environmentally acceptable, as the phenolics are becoming less tolerated by local water and environmental protection agencies.

The quaternary ammonium antimicrobial agent can be generally represented by the formula:

$$R^5R^6R^7R^8N^+X^-$$

wherein $R^5$, $R^6$, $R^7$ and $R^8$ are selected from the group consisting of aryl (e.g., phenyl, furyl, etc.), alkyl arene (e.g., benzyl) and alkyl group, with the proviso that no more than two may be aryl and/or alkyl arene. When any one or more of $R^5$, $R^6$, $R^7$ and $R^8$ are aryl or alkyl arene, the compound is referred to in the art as an aromatic quaternary ammonium compound. It is preferred that no more than two of $R^5$, $R^6$, $R^7$ and $R^8$ have more than 4 carbon atoms, with 8 to 18 carbon atoms being preferred for longer chain alkyl groups. It is possible to have each of $R^5$, $R^6$, $R^7$ and $R^8$ with greater than 18 carbon atoms, and with independent variations in the number of carbon atoms in the groups and distribution of these groups within the compounds being acceptable. Commercial counterparts of these quaternary ammonium antimicrobial agents include, but are not limited to Bardac 2250, Bardac LF, Bardac MB50 (all Bardac products from Lonza), Maquat LC-12S, Maquat 4450-E, Maquat 2525 (all Maquat materials from Mason Chemical Co.), BTC 50, BTC 65, BTC 99, BTC 2125 (all BTC materials from Stepan Chemical Co.), and the like wherein $X^-$ is a counterion, such as chloride.

Another class of antimicrobial agents that can be used in combination with the quaternary ammonium antimicrobial agent or in place of the quaternary ammonium antimicrobial agent can be referred to as a protonated amine compound. The protonated amine compounds are part of a general class of cationic agents. Preferred protonated amine compounds that can be used according to the invention can be represented by the general formula shown above for the quaternary ammonium bearing antimicrobial agents, except that at least one of $R^5$, $R^6$, $R^7$ and $R^8$ is hydrogen. The cationic agents that can be used according to the invention are preferably those that possess antimicrobial properties.

The antimicrobial agent is preferably provided in the concentrate in an amount sufficient to provide the use solution with a desired level of antimicrobial properties. The antimicrobial agent (i.e., quaternary ammonium antimicrobial agent and/or protonated amine compound having antimicrobial properties) is preferably provided in the concentrate in an amount of between about 0.25 wt. % and about 10 wt. %, more preferably in an amount of between about 1 wt. % and about 6 wt. %, and, even more preferably, in an amount of between about 2 wt. % and about 5 wt. %.

The composition of the invention optionally may contain a neutralizing agent for providing the use solution with a desired pH. The neutralizing agent is preferably a basic compound. Exemplary basic compounds that can be used include alkali metal hydroxide, ammonium salt, amine, and mixtures thereof. The use solution preferably has a pH of less than 8.5, a pH less than 8.0 and also a pH between 4.5 and 8.0 or 6.0 and 8.0. The control of the pH level within the range of about 6.0 to about 8.5 has been found to provide another benefit to the compositions of the present invention. The antimicrobial activity of the compositions tends to increase significantly when the compositions of pH 6.0 to 8.5 have their pH levels reduced, as by contact with acidic beverages (which most commercial beverages and juices are). This increased activity upon exposure to beverages with a pH lower than that of the lubricant preserves the antimicrobial activity until such time as the activity is needed most, when sustenance is provided for the growth of the microbes, e.g., by the spillage of beverages. As the presence of the beverage tends to reduce the pH of the lubricant, the activity of the antimicrobial agent is better preserved and more efficiently used by such activation.

The neutralizing agent is preferably provided in the concentrate in an amount sufficient to provide the use solution with a pH of between about 4 and about 9, and, more preferably, between about 5 and about 8. In general, this corresponds to an amount of neutralizing agent in the concentrate of up to about 10 wt. %. Although the pH of the lubricating composition is characterized in terms of the use solution, it should be appreciated that the same pH ranges can be used to characterize the concentrate. In general, it is expected that the concentrate will be diluted to provide a use solution at the location of use of the use solution. Depending upon the water provided at the use location, the resulting use solution might exhibit an increased or decreased pH. The pH of the use solution can then be adjusted by controlling the amount of concentrate provided in the use solution. For example, if the water used for dilution is very acidic or basic, it may be desirable to provide an increased concentration of concentrate relative to the situation where the water for use in dilution is neutral.

The extreme pressure additives that can be incorporated into the lubricant composition of the invention are those that reduce the wear experienced when metal surfaces rub against each other. In general, extreme pressure additives can be referred to as boundary lubricants and are advantageous when the pressures experienced are great enough to cause contact between moving metal surfaces. Extreme pressure additives that can be used according to the invention include organic compounds containing phosphorus, chlorine, or sulfur. Preferred extreme pressure additives that can be used according to the invention include polar components including fatty alcohols, fatty acids, and fatty esters. Preferred extreme pressure additives that can be incorporated into the lubricant composition of the invention include fatty acid diesters, sulfonated fatty acid esters, and linear alcohols. Exemplary phosphate esters are available under the names Monafax (i.e., Monafax 057, Monafax 785, Monafax 939) from Uniqema of Patterson, N.J.; Lubrophos (i.e., Lubrophos LB-400, Lubrophos LK-500, Lubrophos LL-550) and Rhodafac from Rhodia, Inc. of Cranbury, N.J., Aloxlube (i.e., Aloxlube 3050 and Aloxlube 3100) from Alox Corp. of Niagara Falls, N.Y., DePhos (i.e., DePhos HP-739, DePhos P-64, and DePhos 2038) from DeForest Enterprises, Inc. of Boca Raton, Fla.; and Chemfac (i.e., Chemfac PB-093, Chemfac PB-1 33, Chemfac PB-1 36, and Chemfac PB-1 84) from Chemax Inc. of Greenville, S.C. Exemplary fatty acids diesters are available under the name Maxlube (i.e., Maxlube 200, Maxlube 405, and Maxlube 601) from Chemax Inc. of Greenville, S.C. An exemplary sulfonated fatty acid ester is available under the name Alox (i.e., Alox HD-10) from Alox Corp. of Niagara Falls, N.Y. An exemplary linear alcohol is available under the name Alfol (i.e., Alfol 1216) from Condea Vista Company of Houston, Tex.

The extreme pressure additive is preferably provided in the lubricant composition according to the invention in an amount sufficient to reduce wear on moving/contacting parts (typically, metal parts) of the conveyor as can be measured by a reduction in amperage draw of drive motors. It is believed that one would expect the high pressure additive to impede performance of slip of individual containers over the surface of a conveyor. In field testing, however, it has been found that the extreme pressure additive could be used without impeding the performance of slip of individual containers over the conveyor surface.

It should be understood that the extreme pressure additive is an optional component in the lubricant composition, and the lubricant composition can be provided without any extreme pressure additive. When the extreme pressure additive is used, it is preferably provided in an amount that provides the lubricant composition with sufficient lubricity to generate a drop in amperage draw in the drive motors of at least about 10% and, more preferably, about 20% compared with an otherwise identical composition not containing the high pressure additive (under otherwise identical operating conditions conventional for processing beverages). Preferably, the high pressure additive is provided in the concentrate in an amount of between about 0.5 wt. % and about 10 wt. %, more preferably, between about 2 wt. % and about 8 wt. %, and, even more preferably, between about 4 wt. % and about 6 wt. %.

Secondary alcohol alkoxylates are desirable in the lubricant composition for controlling viscosity and freeze thaw properties. In general, the secondary alcohol alkoxylates can be used in place of or in combination with aromatic phosphate esters. The disclosure relating to the use of secondary alcohol alkoxylates in a lubricant composition provided by U.S. patent application Ser. No. 09/231,255, which was filed with the United States Patent and Trademark Office on Jan. 15, 1999, is incorporated herein by reference.

Secondary alcohol alkoxylates that can be used according to the .invention include commercially available materials that may be described as non-ionic surfactants of secondary alcohols having chain lengths of 10 to 20, preferably 10–18, and more preferably 11–15 carbon atoms. Preferred secondary alcohol alkoxylates include secondary alcohol ethoxylates. The secondary alcohol source for the secondary alcohol alkoxylates may be represented by the following structural formula wherein the hydroxyl group is attached to a carbon that is attached to two other carbon atoms

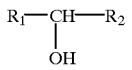

wherein $R_1$ and $R_2$ can be the same or different and can be straight or branched alkyl group. In forming an alkoxylate, the hydroxyl group may be reacted with an alkylene oxide, and in the case of forming an ethoxylate, the compound may include, for example

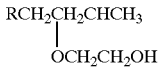

This is a clear example of a linear secondary alcohol ethoxylate. Reference may also be made to *Nonionic Surfactants*, Martin J. Schick, Marcel Dekker, Inc., N.Y., 1966, pp. 86–126. These types of materials are in part commercially provided as Tergitol™ 15-S surfactants, especially the Tergitol™ 15-S series of non-ionic surfactants. These surfactants are provided in a full range of surfactants made with this secondary alcohol hydrophobe, and include 3, 5, 7, 9, 12, 15, 20, 30 and 40 mole ethoxylates. The commercial and trade descriptions of the Tergitol™, especially the Tergitol™ Series, followed with a number (e.g., Tergitol™ 15-S-5) indicates the average moles of ethylene oxide in the molecule. The compounds also may be defined according to the formula:

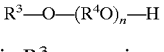

wherein $R^3$- comprises the nonhydroxy portion of a secondary alcohol group (e.g., linear, branched or cyclic secondary alcohol group) of from 10 to 20 carbon atoms, preferably of from 10 to 18 carbon atoms, more preferably of from 11 to 15 carbon atoms, $R^4$- is ethylene and/or propylene, preferably ethylene, or predominantly ethylene (i.e., contains a mixture of ethylene and propylene which is more than 50 mol percent ethylene), and n is 3 to 8 when $R^4$- is propylene, and is 3 to 12 when $R^4$- is ethylene, and is 3 to 10 when $R^4$- is a mixture of ethylene and propylene.

The compounds may be provided as mixtures with other alkoxylates and alkoxylates of alcohols and do not have to be added in a pure form. Non-linear alcohol alkoxylates and non-secondary alcohol alkoxylates and isomeric forms of the alkoxylated secondary alcohol may also be harmlessly present within the component and the final solution.

The secondary alcohol alkoxylate component need not be included in the lubricant composition according to the invention. When the secondary alcohol alkoxylate component is included in the concentrate, it is preferably provided in an amount of between about 0.1 wt. % and about 8 wt. %, more preferably between about 0.5 wt. % and about 5 wt. %, and, even more preferably between about 1 wt. % and about 4 wt. %.

The lubricant composition preferably includes a corrosion inhibitor. The applicants have found that certain corrosion inhibitors provide a lubricant composition that generates a conveyor surface that is shinier and more desirable than lubricant compositions that do not include a corrosion inhibitor. Preferred corrosion inhibitors which can be used according to the invention include phosphonates, phosphonic acids, triazoles, organic amines, sorbitan esters, carboxylic acid derivatives, sarcosinates, phosphate esters, zinc, nitrates, chromium, molybdate containing components, and borate containing components. Exemplary phosphates or phosphonic acids are available under the name Dequest (i.e., Dequest 2000, Dequest 2006, Dequest 2010, Dequest 2016, Dequest 2054, Dequest 2060, and Dequest 2066) from Solutia, Inc. of St. Louis, Mo. Exemplary triazoles include tolylytriazole and benzotriazoles. Exemplary triazoles are available under the name Cobratec (i.e., Cobratec 100, Cobratec TT-50-S, and Cobratec 99) from PMC Specialties Group, Inc. of Cincinnati, Ohio. Exemplary organic amines include aliphatic amines, aromatic amines, monoamines, diamines, triamines, polyamines, and their salts. Exemplary amines are available under the names Amp (i.e., Amp-95) from Angus Chemical Company of Buffalo Grove, Ill.; WGS (i.e., WGS-50) from Jacam Chemicals, LLC of Sterling, Kans.; Duomeen (i.e., Duomeen O and Duomeen C) from Akzo Nobel Chemicals, Inc. of Chicago, Ill.; DeThox amine (C Series and T Series) from DeForest Enterprises, Inc. of Boca Raton, Fla.; Deriphat series from Henkel Corp. of Ambler, Pa.; and Maxhib (AC series) from Chemax, Inc. of Greenville, S.C. Exemplary sorbitan esters are available under the name Calgene (LA-series) from Calgene Chemical, Inc. of Skokie, Ill. Exemplary carboxylic acid derivatives are available under the name Recor (i.e., Recor 12) from Ciba-Geigy Corp. of Tarrytown, N.Y. Exemplary sarcosinates are available under the names Hamposyl from Hampshire Chemical Corp. of Lexington, Mass.; and Sarkosyl from Ciba-Geigy Corp. of Tarrytown, N.Y.

The lubricant composition preferably includes a corrosion inhibitor for providing enhanced luster to the metallic portions of the conveyor. It should be appreciated that a corrosion inhibitor need not be incorporated into the lubricant composition. When the corrosion inhibitor is incorporated into the lubricant composition, it is preferably included in the concentrate in an amount of between about 0.05 wt. % and about 5 wt. %, more preferably between about 0.5 wt. % and about 4 wt. %, and, even more preferably, between about I wt. % and about 3 wt. %.

In order to provide a single phase lubricant composition, it is desirable to balance the anionic and cationic materials provided in the lubricant composition. In general, if the ratio of anionic to cationic materials is too far off, it is expected that the lubricant composition will phase separate. In addition, the relative proportion of anionic to cationic materials in the lubricant composition (i.e., the relative proportions of the combined total of phosphate ester (anionics) compared to the total of quaternary ammonium antimicrobial agents on a weight to weight basis) is believed to affect the degree to which sedimentation, precipitation, cloudiness and deposits occur in at least certain of the lubricant compositions when contacted with beverages. The higher the proportion of anionics to cationics, the more strongly the compositions resist deposits. It is preferred that the weight ratio of anionics to cationics is at least 1.5:1, preferably within the range of 2.0:1 to 10.0:1, more preferably within the range of 2.0:1 to 8.0:1. As noted, the greater the amount of beverage to which the lubricant is likely to be exposed, the higher the preferred ratio of anionics to cationics. The amount of materials within the concentrate compositions may also be described in terms of 7–30 weight percent anionic materials and 1–5 weight percent cationic materials. These percentages allow for a maximum range of about 30:1 to 1.28:1 ratios by weight of anionic materials to cationic materials. Unless otherwise stated, all amounts described in the examples are percentages by weight.

Additional ingredients that do not significantly and adversely affect the stability and lubricating properties of the composition may also be present in the compositions of the invention. Coupling agents, which are materials that have an affinity for both hydrophilic and hydrophobic materials may be included within the compositions. Coupling agents are also referred to as hydrotropes, chemicals that have the property of increasing the aqueous solubility of variously slightly soluble organic compounds. The compounds often have both hydrophilic and hydrophobic functionalities within a single molecule to display affinity to both environments, and are commonly used in the formulation of liquid detergents.

Another attribute of the present invention is that the lubricants of the invention tend to have a wider range of utility with respect to the container material and the conveyor material. It has usually been the practice in the art to specifically design lubricant compositions for use with particular container compositions and conveyor support materials. The supporting surfaces on conveyors may comprise fabric, metal, plastic, composite and mixtures of these materials. Lubricants would preferably be compatible with a variety of these surfaces. Similarly, bottle compositions may comprise metals, glasses, papers, treated papers, coated papers, laminates, ceramics, polymers, and composites, and the lubricant compositions would preferably have a range of compatibility with all of these materials. Although there may be some variation in the quality of performance with certain materials, the lubricants of the present invention do tend to display a greater latitude in acceptable performance with a range of materials than many lubricant compositions.

Possible optional agents with high degrees of utility include chelating agents (e.g., EDTA), nonionic detergents, and alkalating agents, e.g, potassium, sodium hydroxide, or alkanolamines. The preferred chelating agents for use in the practice of the present invention are the amine-type acetic acids. These chelating agents typically include all of the poly(amine-type) chelating agents as described in U.S. Pat. No. 4,873,183. Other chelating agents such as nitrilotriacetic acid, alkali metal salts of glucoheptanoate, and organic substituted phosphoric acid, and their equivalents are also useful in the practice of the present invention. When the lubricant composition includes a chelating agent, it is preferably included in an amount of between about 0.25 wt. % and about 15 wt. %, more preferably between about 0.5 wt. % and about 8 wt. %, and, even more preferably, between about 1 wt. % and about 5 wt. %.

Nonionic surfactants that can be included in the lubricant composition according to the invention include those nonionic surfactants described in International Publication No. WO 96/02616 at, for example, page 8, lines 1–14. The entire disclosure and, in particular, the reference to page 8, lines 1–14 of International Publication No. WO 96/02616 is incorporated herein by reference.

Nonionic surfactants that can be incorporated into the lubricant composition according to the invention are preferably hydrophobic compounds that bear essentially no charge and exhibit a hydrophilic tendency due to the presence of oxygen in the molecule. Nonionic surfactants encompass a wide variety of polymeric compounds that include, specifically, but not exclusively, ethoxylated alkyl phenols, ethoxylated aliphatic alcohols, ethoxylated amines, ethoxylated ether amines, carboxylic esters, carboxylic amides, ether carboxylates, and polyoxyalkylene oxide block copolymers. Particular nonionic surfactants which can be used include alkoxylated (preferably, ethoxylated) alcohols having the general formula:

$$R_1O((CH_2)_mO)_n$$

wherein $R_1$ is an aliphatic group having from about 8 to about 24 carbon atoms, m is a whole number from 1 to about 5, and n is a number from 1 to about 40 which represents the average number of alkylene oxide groups on the molecule.

When a non-ionic surfactant is incorporated into the lubricant composition, it is preferably included in an amount of between about 0.1 wt. % and about 8 wt. %, more preferably between about 0.5 wt. % and about 5 wt. %, and, even more preferably, between about 1 wt. % and about 4 wt. %.

The following table summarizes the preferred ranges of components in the concentrate of the lubricant composition according to the invention.

TABLE 1

| Ingredient | Preferred Range (wt. %) | More Preferred Range (wt. %) | Further Preferred Range (wt. %) |
|---|---|---|---|
| Diluent (Water) | 5–95 | 20–80 | 35–75 |
| Antimicrobial Agent | 0.25–10 | 1–6 | 2–5 |
| Lubricating Agent | 1–20 | 3–15 | 7–13 |
| Secondary Alcohol Alkoxylate | 0–8 | 0.5–5 | 1–4 |
| Neutralizing Agent | 0–10 (Sufficient to achieve use solution pH between 4–9) | | |
| Chelating Agent | 0–15 | 0.5–8 | 1–5 |
| Corrosion Inhibitor | 0–5 | 0.5–4 | 1–3 |
| Extreme pressure additive | 0–10 | 2–8 | 4–6 |
| Nonionic Surfactant | 0–8 | 0.5–5 | 1–4 |

In a synthetic lubricant environment, the invention has found that quaternary ammonium antimicrobial agents and especially the linear quaternary compounds act as lubricants in combination with the linear and phenol phosphate esters. At least one of the referenced art (e.g., PCT GB95/01641, page 17, lines 12–18) specifically shows that the combination of quaternary ammonium compounds with the alkyl (linear) phosphate esters did not affect lubricity. The finding that the combination of the quaternary ammonium antimicrobial agents with the combination of esters of the present invention actually increases lubricity (reduces the coefficient of friction) provides a basis for the assertion of unexpected results in the defined chemical classes of compounds.

The lubricant composition according to the invention can be characterized as non-fatty acid based lubricant composition when the composition contains little or no fatty acid lubricating component. In contrast, U.S. Pat. Nos. 5,391,308 to Despo and 5,244,589 to Liu et al. can be characterized as describing fatty acid based lubricant compositions because of the presence of greater than 5 wt. % fatty acid in the concentrate. It should be understood that for purposes of providing lubricating properties, a fatty acid lubricant could be considered a carboxylic acid containing component further containing a $C_{6-24}$ carbon atom chain. In addition, the fatty acid component can be characterized as having saponifiable groups. The non-fatty acid-based lubricant composition according to the invention includes substantially no fatty acid lubricant. In general, this means that if any fatty acid lubricant is present in the lubricant composition concentrate according to the invention, it is present in an amount of less than 1 wt. %. It should be understood that fatty acids might be present in the lubricant composition according to the invention as a result of equilibrium with the fatty acid diester component. Although the fatty acid diester component is generally considered as not having saponifiable groups, it is expected that equilibrium conditions may generate a small amount of molecules having saponifiable (carboxylic acid) groups. Preferably, the amount of fatty acid in the lubricant composition concentrate according to the invention is less than 0.5 wt. %, and, more preferably, less than 0.1 wt. %. Furthermore, the lubricant composition concentrate preferably includes substantially no alkyl benzene sulfonate components. By substantially no alkyl benzene sulfonate component, it is meant that the concentrate, if it includes any alkyl benzene sulfonate component, it includes it in an amount of less than 0.02 wt. %, and more preferably in an amount of less than 0.01 wt. %.

It should be appreciated that when the starting materials used to prepare the lubricant composition are combined, there may be some degree of interaction and the resulting composition may exhibit a level of dynamic equilibrium. In this situation, certain of the components may change slightly. It should be understood that the characterization of the composition according to the invention by starting materials is meant to include the composition in its dynamic equilibrium.

| Exemplary Formula | | |
|---|---|---|
| Raw Material | Chemical Name | (%) |
| Soft water | | 65.5 |
| Phosphate Ester | $C_{10-12}$ alkyl phosphate ester, 5 EO units | 12.5 |
| | phenol ethoxylated phosphate ester | 2.50 |
| | didecyl dimethyl ammonium chloride, 50% | 5.0 |
| | Tetrasodium EDTA, 40% | 10.0 |
| | NaOH (NaOH, 50%) | 2.0 |
| | $C_{12-15}$ linear alcohol, 7 EO | 2.50 |
| | | 100.0 |

The following examples include a shorthand description of several components. The description of components A1–A11 is provided below.

A1 Alkyl ethoxylated phosphate ester

A2 Phenol ethoxylated phosphate ester

A3 Tetrasodium EDTA

A4 Didecyl dimethyl ammonium chloride

A5 Sorbitan monooleate

A6 Alkyl polyglycoside

A7 Fatty alcohol ethoxylate (octyl phenol ethoxylate)

A8 Fatty acid diester (Maxlube 200)

A9 Secondary alcohpl ethoxylate

A10 Linear alcohol ethoxylate

A11 TEA/phos acid/amino-trimethylene phosphonic acid (Maxhib PT-10T)

Background Example A

Two formulae were prepared as set out below. The first formula contained the blended phosphate esters, EDTA, NaOH, and linear quaternary ammonium antimicrobial agent. The second formula was identical to the first formula with the exception that the second formula does not contain the linear quaternary ammonium antimicrobial agent.

0.1% use solutions of each formula were prepared in softened water. This solution was sprayed on the short track conveyor that was set up with glass bottles held stationary as the stainless steel conveyor rotated at 100 rpm. The drag was measured with a load cell, which was in turn connected to a computer, which plotted the COF (kinetic) based on the drag and the load. A graph displaying the coefficient of friction (COF) versus time for the two formulae tested according to this example is provided by FIG. 1.

Formulas

| Raw Material | Chemical Name | Formula (%) | |
|---|---|---|---|
| Soft Water | | 68.0 | 73.0 |
| A1 | $C_{10-12}$ alkyl phosphate ester, 5 EO units | 12.5 | 12.5 |
| A2 | phenol ethoxylated phosphate ester | 2.5 | 2.5 |
| A3 | Tetrasodium EDTA, 40% | 10.0 | 10.0 |
| | NaOH (NaOH, 50%) | 2.0 | 2.0 |
| A4 | didecyl dimethyl ammonium chloride, 50% | 5.0 | 0.0 |
| | | 100.0 | 100.0 |

The inclusion of the linear quaternary ammonium antimicrobial agent provides increased lubricity compared with a composition not containing the linear quaternary ammonium antimicrobial agent.

Background Example B

Two formulas of lubricating agents were prepared as set out below. The first formula contained the blended phosphate esters, EDTA, NaOH, nonionic surfactant, and linear quaternary ammonium antimicrobial agent. In the second formula, the linear quaternary ammonium antimicrobial agent was replaced with benzyl quaternary ammonium antimicrobial agent.

Figure 2:
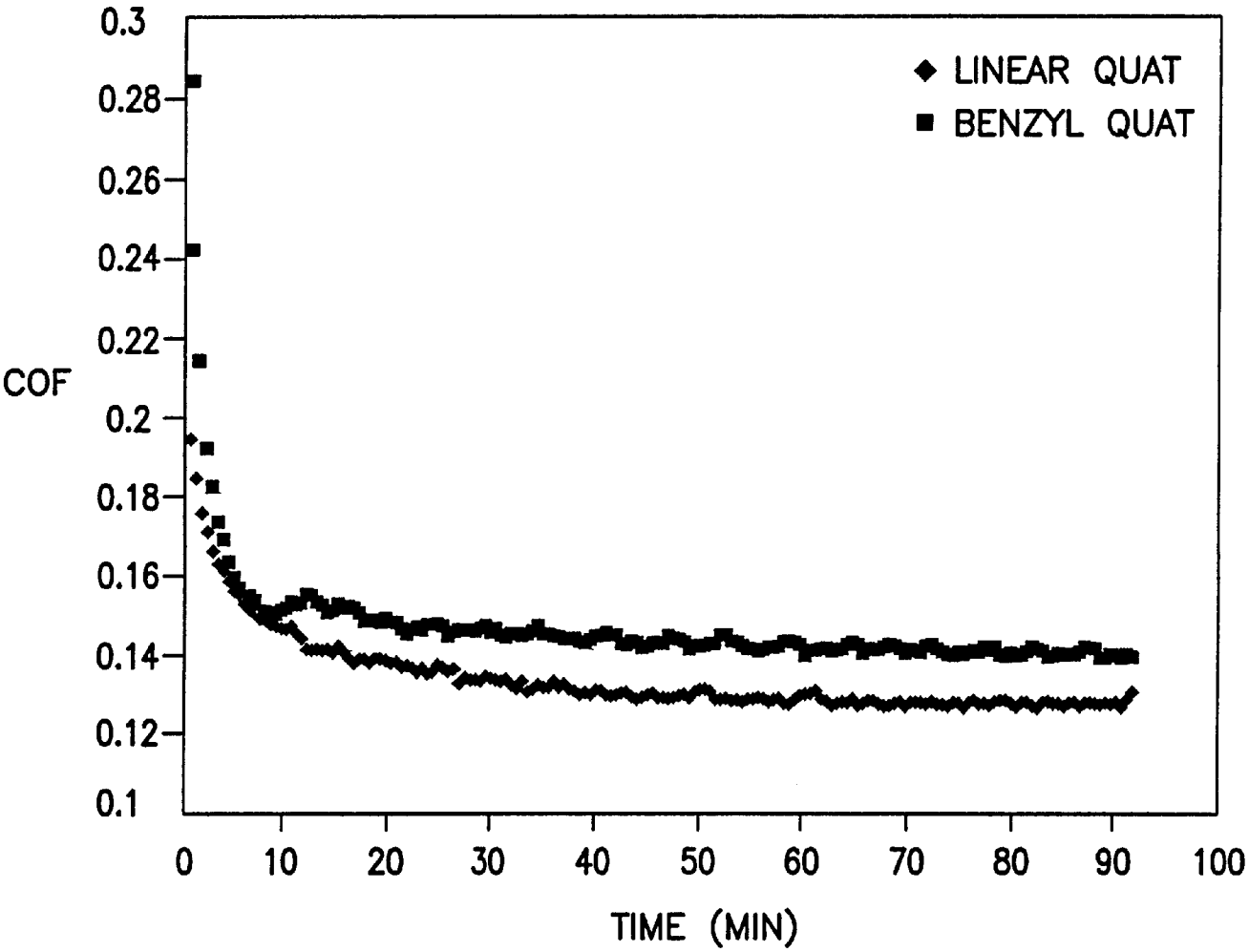
FIG. 2 shows a graph of data relating the Coefficient of Friction (kinetic) of phosphate ester lubricating compositions containing either linear quaternary ammonium biocides or aromatic quaternary ammonium biocides.

0.1% use solutions of each formula were prepared in softened water. This solution was sprayed on the short track conveyor that was set up with glass bottles held stationary as the stainless steel conveyor rotated at 100 rpm. The drag was measured with a load cell, which was in turn connected to a computer that plotted the COF (kinetic) based on the drag and the load. A graph displaying the coefficient of friction (COF) versus time for the two formulae tested according to this example is provided in FIG. 2.

Formula

| | | Formula (%) | |
|---|---|---|---|
| Raw Material | Chemical Name | Comp. 1 | Comp. 2 |
| Soft Water | | 68.0 | 68.0 |
| A1 | $C_{10-12}$ alkyl phosphate ester, 5 EO units | 12.5 | 12.5 |
| A2 | Phenol ethoxylated phosphate ester | 2.5 | 2.5 |
| A3 | Tetrasodium EDTA, 40% | 10.0 | 10.0 |
| | NaOH (NaOH, 50%) | 2.0 | 2.0 |
| A4 | didecyl dimethyl ammonium chloride, 50% | 5.0 | 0.0 |
| | benzyl quat, 50% (a mixture of alkyldimethyl-benzyl ammonium chlorides) | 0.0 | 5.0 |
| | | 100.0 | 100.0 |

The incorporation of the linear quaternary ammonium antimicrobial agent provides improved lubricity compared with an otherwise identical formula except where the linear quaternary antimicrobial agent is replaced with a benzyl quaternary ammonium antimicrobial agent.

Background Example C

Two formulae were prepared as set out below. The first formula contained an alkyl phosphate ester and the second formula contained a blend of alkyl and aryl phosphate esters. Both formulas contained EDTA, nonionic, NaOH, and linear quaternary ammonium antimicrobial agent.

The viscosity of the concentrates was measured in triplicate on a Brookfield viscometer model RVT at 51, 78 and 116° F. (spindle #3, 100 rpm, factor=10). The results are provided below.

Formula

| Raw Material | Chemical Name | Formula (%) | |
|---|---|---|---|
| Soft Water | | 65.5 | 65.5 |
| A1 | $C_{10-12}$ alkyl phosphate ester, 5 EO units | 15.0 | 12.5 |
| | Tetrasodium EDTA, 40% | 10.0 | 10.0 |
| | NaOH (NaOH, 50%) | 2.0 | 2.0 |
| A4 | didecyl dimethyl ammonium chloride, 50% | 5.0 | 5.0 |
| A10 | $C_{12-15}$ linear alcohol, 7 EO | 2.5 | 2.5 |
| A2 | phenol ethoxylated phosphate ester | | 2.5 |
| | | 100.00 | 100.00 |

Results

| Temperature (° F.) | Phosphate Ester(s) | Average Viscosity (cps) |
|---|---|---|
| 51 | Alkyl and Phenol blend | 50 |
| 78 | Alkyl and Phenol blend | 51 |
| 116 | Alkyl and Phenol blend | 49 |
| 51 | Alkyl | 170 |
| 78 | Alkyl | 132 |
| 116 | Alkyl | 64 |

Blending phenol phosphate ester with alkyl phosphate ester in the formula reduces the viscosity at all temperatures tested and the resultant low viscosity appears to be temperature independent. This property provides for ease of application on a conventional conveyor apparatus.

Background Example D

Formulas containing alkyl phosphate ester and linear quaternary ammonium antimicrobial agent were prepared with various nonionic and anionic adjuvants to determine the effect on lubricity. A control containing phenol phosphate ester, a control with higher level of alkyl phosphate ester, and a control with no adjuvant were prepared for comparative purposes. The formulas are provided below.

Figure 3:
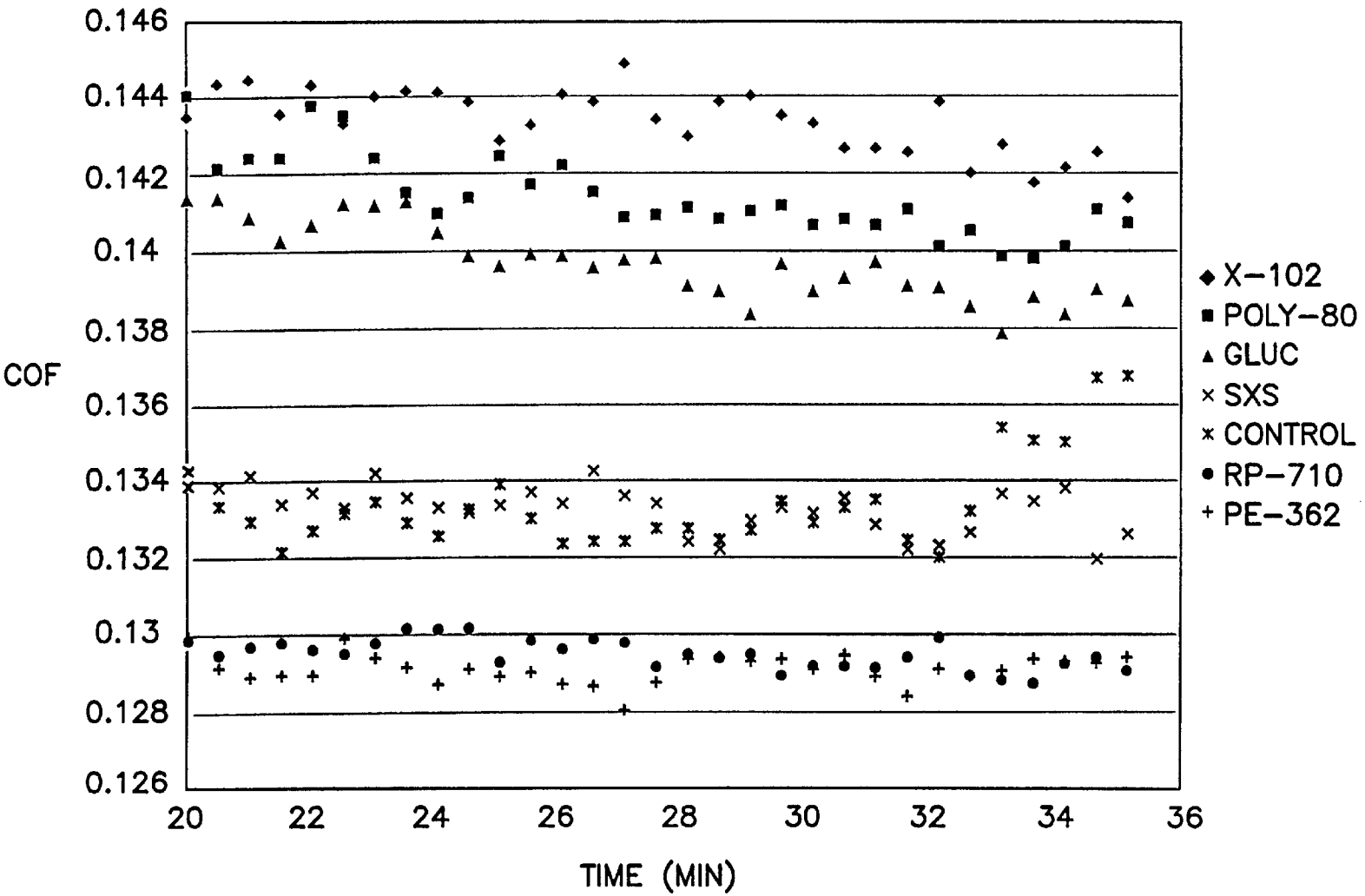
FIG. 3 shows a graph of data relating the Coefficient of Friction (kinetic) for a lubricant composition of the invention as compared to various lubricant compositions with various couplers (e.g., hydrotropes).

0.1% use solutions of each formula were prepared in softened water. This solution was sprayed on the short track conveyor that was set up with glass bottles held stationary as the stainless steel conveyor rotated at 100 rpm. The drag was measured with a load cell, which was in turn connected to a computer that plotted the COF based on the drag and the load. Each sample was run two or more times, and the average COF was calculated. The results are reported in Table 2 and shown in FIG. 3. A-7 is a fatty alcohol ethoxylate (octyl phenol ethoxylate).

TABLE 2

| Raw Material | Chemical Name | 1 | 2 | 3 | 4 | 5 | 6 | 7 |
|---|---|---|---|---|---|---|---|---|
| Soft Water | above | 68.00 | 65.50 | 61.70 | 65.50 | 65.50 | 65.50 | 65.50 |
| A1 | above | 12.50 | 15.00 | 12.50 | 12.50 | 12.50 | 12.50 | 12.50 |
| A3 | above | 10.00 | 10.00 | 10.00 | 10.00 | 10.00 | 10.00 | 10.00 |
| NaOH, 50% | above | 2.00 | 2.00 | 2.00 | 2.00 | 2.00 | 2.00 | 2.00 |
| A4 | above | 5.00 | 5.00 | 5.00 | 5.00 | 5.00 | 5.00 | 5.00 |
| $C_{12-15}$ linear alcohol | above | 2.50 | 2.50 | 2.50 | 2.50 | 2.50 | 2.50 | 2.50 |
| SXS, 40% | Na xylene Sulfonate | | | 6.30 | | | | |
| A2 | above | | | | 2.50 | | | |
| A5 | sorbitan monooleate | | | | | 2.50 | | |
| A6 | Alkyl poly glycoside | | | | | | 2.50 | |
| A7 | | | | | | | | 2.50 |
| Total | | 100.00 | 100.00 | 100.00 | 100.00 | 100.00 | 100.00 | 100.00 |

The phenol and alkyl phosphate esters improved lubricity over the control, while none of the other adjuvants showed this advantage.

Background Example E

Figure 4:
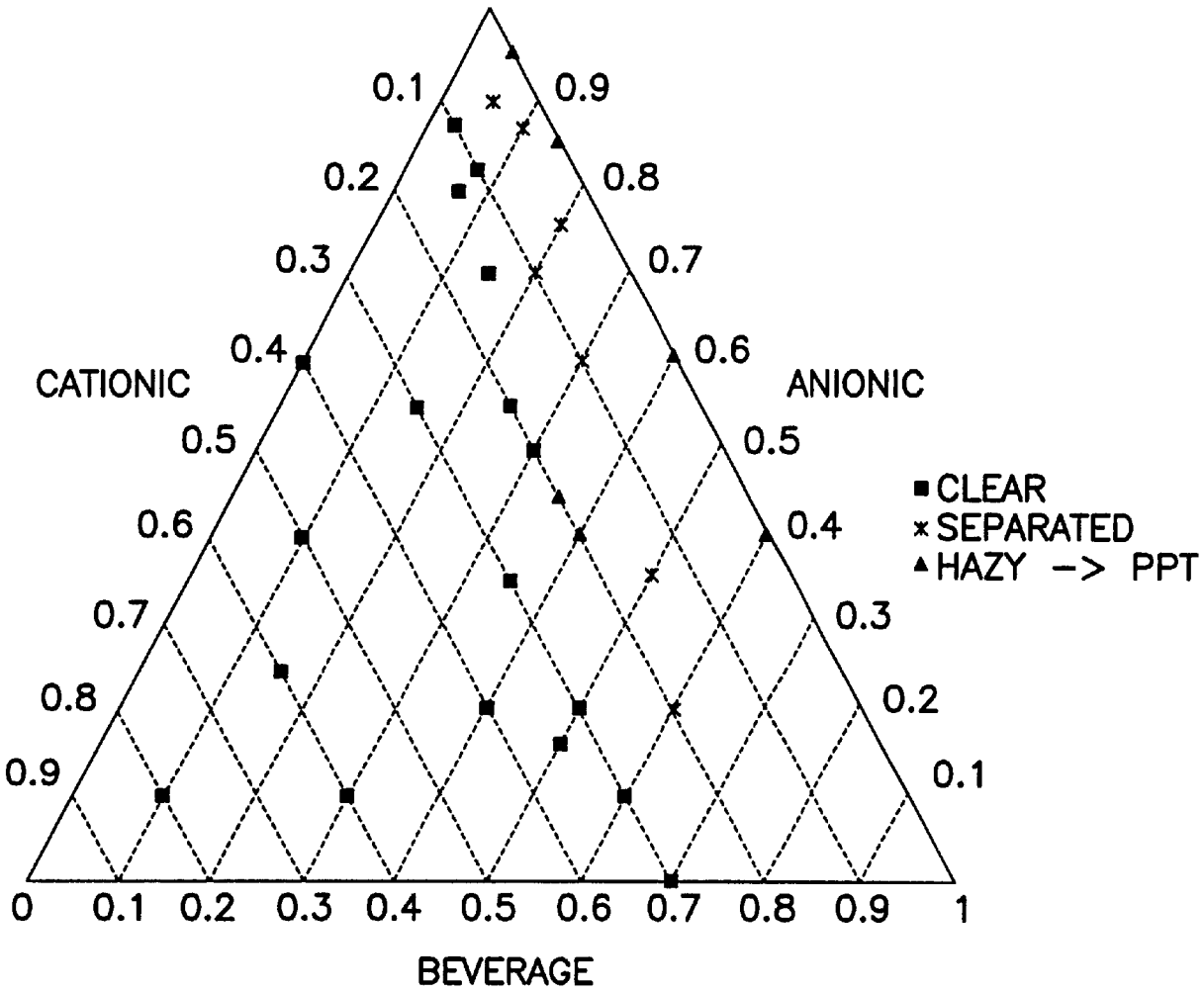
FIG. 4 shows a triangular graph of the effects of variations among anionic surfactants, cationic surfactants and beverage.

This example examines the ratios of phosphate ester and quaternary ammonium antimicrobial agent that does not interact with beverage to form a precipitate. A 40% phosphate ester solution in soft water was combined with 10% active linear quaternary ammonium antimicrobial agent solution in water and a cola beverage at various levels. After one day, the samples were observed for clarity. Samples were rated as clear, hazy, and separated. Over time, all hazy samples formed precipitates. The results of this example are reported in the ternary plot in FIG. 4.

At higher levels of beverage, a higher ratio of anionic to cationic surfactant is required to maintain clarity. The ratio ranges from about 1.5:1 at very low levels of beverage, to 2.5:1 at 50% beverage and 16:1 at very high levels of beverage.

EXAMPLES OF THE INVENTION

The present invention is further enabled and taught in the following non-limiting examples. Amongst other aspects of the invention that are evidenced by these non-limiting examples is at least the fact that some of the lubricating compositions not only maintain the effective performance of the conveying systems to which they are applied, even under high stress or high load-bearing conditions, but also that some of the lubricating compositions have improved the appearance of the metal on the conveying system, visibly increasing the shine on the exposed metal. These and other aspects of the invention are shown in the accompanying examples.

The lubricant may also comprise a corrosion inhibitor, such as a triazole, such as a triazole with an aromatic substituent, such as a triazole selected from the group consisting of benzotriazole and tolyltriazole. In the performance of the process of the invention, the presence of a triazole, where there is application of the composition to a used metallic conveying surface and operation of said conveyor, the composition increases the luster of said metallic conveying surface.

The lubricant may also comprise an extreme pressure additive, such as those derivatives that are prepared from the Diels-Adler adduct of linoleic acid and methacrylic acid, such as the 22–25 mole polyethyleneglycol diester of the mixture of 5- and 6-carboxy-4-hexyl-2-cyclohexene-1-octanoic acid which is commercially available from Chemax, Inc. as Maxlube 200.

Example 1

Non-Phenolic Lubricant

This example compares the compatibility of three lubricating compositions with mild steel. The first lubricating composition is a composition according to the invention that is characterized as Solution 1. The second lubricating composition is a composition described in commonly assigned U.S. patent application Ser. No. 09/002,976 that was filed with the United States Patent and Trademark Office on Jan. 5, 1998. The third lubricating composition is available under the name Sani-Glide™ that is a commercially available fatty acid phenolic containing lubricant composition from Ecolab, Inc. The lubricating composition described in U.S. application Ser. No. 09/002,976 is referred to herein as RA-1.

Solution 1 is prepared as follows:

| | | |
|---|---|---|
| 1. | Deionized Water | 67.75 |
| 2. | A4 | 5.0 |
| 3. | A1 | 12.5 |
| 4. | Propylene Glycol | 1.0 |
| 5. | NaOH 50% | 1.00 |
| 6. | A8 (5- and 6- carboxy-4-hexyl-2-cyclohexene-1-octanoic acid, 22–25 mole polyethylene glycol diester) | 5.0 |
| 7. | A9 ($C_{12-14}$ secondary alcohol ethoxylate, 7 moles EO) | 1.0 |
| 8. | A10 (defined above) | 1.5 |
| 9. | Tetrasodium EDTA, 40% | 5.0 |
| 10. | Triethanolamine | 0.25 |

The components of the solution 1 were mixed together in the order listed and mixed each time for 5 minutes with the exception that item 8 was mixed in for 30 minutes. The resulting solution was observed to be yellow and slightly hazy.

The amounts of the ingredients in Lubricating Solution RA-1 are as follows:

| | |
|---|---|
| 1. Deionized Water | 60.0 |
| 2. A4 | 5.0 |
| 3. A1 | 12.5 |
| 4. A2 | 2.5 |
| 5. NaOH 50% | 2.0 |
| 8. A10 | 8.0 |
| 9. Tetrasodium EDTA, 40% | 0.0 |

The procedure for the testing of the solutions was to load a 1"×3" (2.5×7.6 cm) coupon of mild steel in 0.7% (v) soft water solution at room temperature (Rt) 10 and compare the physical/chemical effects with immersion of the coupon into lubricant solutions. "S1." is used to identify a slight characteristic and "Mod." is used to identify a moderate characteristic.

| 24 hr | 1020 steel | 1018 steel |
|---|---|---|
| $H_2O$ | Surface darkening (24 hr) | Surface darkening (24 hr) |
| Solution 1 | Sl. pitting at top (24 hr) | Mod. pitting at top (24 hr) |
| Sani-Glide ™ | Very Sl pitting at top (24 hr) | Slight pitting throughout the surface (24 hr) |
| RA-1 | Sl. - Mod. Pitting at top with surface darkening | |
| **72 hour** | **1020 steel** | **1018 steel** |
| $H_2O$ | Surface darkening | Surface darkening |
| Solution 1 | Sl. pitting at top | Mod. pitting at top |
| Sani-Glide ™ | Very Sl. pitting at top | Sl. pitting throughout |

Example 2

The purpose of these examples is to determine if Solution 1 permeates HDPE (High Density Polyethylene)

Procedure: 3×16 oz. HDPE cylindrical bottles were filled with 100 ml of DI water and then placed in a 4 Liter beaker containing 500 ml. of lubricating solution. Periodically the contents of the bottles were checked for foam by pouring contents into 8 oz. glass jars and shaking. A central bottle containing 100 ml of (Deionized water) DI was used to compare foam. Where dashes (—) are present in the data, which indicated that no foaming occurred. A completely blank space indicates that no observation was made or data taken. Where a plus sign (+) appears, some foaming was noted, indicating that the HDPE had been permeated by the composition being tested.

| Lube | Conc. | 1 hr. | 3 hr. | 24 hr. | 96 hr. |
|---|---|---|---|---|---|
| Sani-Glide ™ | 0.7% | — | — | — | — |
| | | — | — | — | — |
| | | — | | — | — |
| Solution 1 | 0.7% | — | | — | — |
| | | — | | — | — |
| | | — | | +* | * |
| Water | Control | — | | | |

*This sample was accidentally contaminated with the lubricating solution — The solution had dripped onto the cover of glass jar used to seal the container during testing. The remaining two tests for a composition of the invention show no foaming.

Example 3

The purpose of this example was to compare the lubricity of several lubricant compositions using slider testing (as described herein). The results of this test are reported in Table 3. The lubricant composition identified as FALC is a fatty acid lubricant control that is available under the name LubriKlenz LF from Ecolab, Inc.

TABLE 3

Stainless/Mild Steel

| SAMPLE | DILUENT | LUBE USE CONC | FORCE, g | L = 227 g COF | RUN ORDER | Rel COF |
|---|---|---|---|---|---|---|
| FALC | DI | 0.1 | 26 | 0.1145 | 1 | 1 |
| Sani- | DI | 0.1 | 24 | 0.1057 | 2 | 0.949 |

TABLE 3-continued

| Stainless/Mild Steel | | | | | | |
|---|---|---|---|---|---|---|
| SAMPLE | DILUENT | LUBE USE CONC | FORCE, g | L = 227 g COF | RUN ORDER | Rel COF |
| Glide ™ | | | | | | |
| Sani-Glide ™ | DI | 0.25 | 23.5 | 0.1035 | 3 | 0.955 |
| Sani-Glide ™ | DI | 0.5 | 24 | 0.1057 | 4 | 1.004 |
| Sani-Glide ™ | DI | 0.75 | 26.5 | 0.1167 | 5 | 1.142 |
| FALC | DI | 0.1 | 22.5 | 0.0991 | 6 | 1 |
| FALC | DI | 0.1 | 22.5 | 0.0991 | 1 | 1 |
| Solution 1 | DI | 0.1 | 24 | 0.1057 | 2 | 1.076 |
| Solution 1 | DI | 0.25 | 24.5 | 0.1079 | 3 | 1.109 |
| Solution 1 | DI | 0.5 | 25 | 0.1101 | 4 | 1.142 |
| Solution 1 | DI | 0.75 | 25 | 0.1101 | 5 | 1.152 |
| FALC | DI | 0.1 | 21.5 | 0.0947 | 6 | 1 |
| FALC | DI | 0.1 | 21.5 | 0.0947 | 1 | 1 |
| RA-1 | DI | 0.1 | 23 | 0.1013 | 2 | 1.066 |
| RA-1 | DI | 0.25 | 23 | 0.1013 | 3 | 1.061 |
| RA-1 | DI | 0.5 | 23.5 | 0.1035 | 4 | 1.080 |
| RA-1 | DI | 0.75 | 23.5 | 0.1035 | 5 | 1.076 |
| Solution 1 | DI | 0.5 | 24 | 0.1057 | 6 | 1.095 |
| FALC | DI | 0.1 | 22 | 0.0969 | 7 | 1 |

As can be seen from these results all of the lubricating solutions provide an effective level of lubrication.

Example 4

This example is provided to show the effect of the addition of corrosion inhibitors to Solution 1. The solutions compared are described in Table 4.

TABLE 4

| Solution | 1 | 1 | 2 | 3 | 4 | 5 | 6 | 7 |
|---|---|---|---|---|---|---|---|---|
| Deionized Water | 67.75 | 67.75 | 66.50 | 66.5 | 66.5 | 66.75 | 66.75 | 64.75 |
| A4 | 5.00 | 5.00 | 5.00 | 5.00 | 5.00 | 5.00 | 5.00 | 5.00 |
| A1 | 12.50 | 12.50 | 12.50 | 12.50 | 12.50 | 12.50 | 12.50 | 12.50 |
| Propylene Glycol | 1.00 | 1.00 | 1.00 | 1.00 | 1.00 | 1.00 | 1.00 | 1.00 |
| A10 Linear Alc. Ethox. | 1.50 | 1.50 | 1.50 | 1.50 | 1.50 | 1.50 | 1.50 | 1.50 |
| A9 | 1.00 | 1.00 | 1.00 | 1.00 | 1.00 | 1.00 | 1.00 | 1.00 |
| Tetrasodium EDTA, 40% | 5.00 | 5.00 | 5.00 | 5.00 | 5.00 | 5.00 | 5.00 | 5.00 |
| Triethanol amine | 0.25 | 0.25 | 0.25 | 0.25 | 0.25 | 0.25 | 0.25 | 0 |
| A8 | 5.00 | 5.00 | 5.00 | 5.00 | 5.00 | 5.00 | 5.00 | 5.00 |
| alkyl poly-glucoside APG425 | | 1.00 | | | | | | |
| Dequest* 2010 | | | 1.00 | 1.00 | 1.00 | | | |
| Oleyl sarcosine | | | | | | 1.00 | | |
| TEA, phosphoric acid/ amino-trimethylene phosphonic acid) A11 | | | | | | | 1.00 | 2.00 |
| Benzotriazole | | | | 0.040 | | | | |
| tolyltriazole | | | | | 0.040 | | | 1.25 |
| NaOH 50% | 1.00 | | 1.25 | 1.25 | 1.25 | 1.00 | 1.00 | 1.25 |
| | 100.00% | 100.00% | 100.00% | | | 100.00% | 100.00% | 100.00% |

Dequest 2010 comprises 1-hydroxyethylidene-1,1-diphosphonic acid in water (~60% water).

The solutions were applied to steel coupons. Solution 5 displayed two phases. Solution 4 appeared hazy after 24 hours. Solutions 1–6 provided steel coupons that looked better (shinier) than solution 1. Solutions of RA-1 and of water were compared, and it was determined that Solutions 1–6 looked better (shinier) than Solution RA-1 and a solution containing water.

Example 5

This example evaluates corrosion when using the samples identified in Table 5.

Procedure: 1×3 1020 mild steel coupons were cleaned in 1% Ultrasil 390 from Ecolab Inc. using a non-abrasive scrubbing pad, rinsed with DI water and acetones, 200 ml of 0.7% test solutions and placed in 8 oz. Bottles along with one test coupon. The samples according to the present invention are identified in relationship to Solution 1 that is described above. Samples 1–6 are characterized by including Solution 1 and another component identified in Table 5.

The data provided in Table 5 demonstrates that all of samples 1–6 provide an acceptable level of corrosion. That is, they all provide an MPY value below five.

TABLE 5

| Sample | Description | Initial Weight | Final Weight | MPY |
|---|---|---|---|---|
| Sani-Glide ™ | | 41.7505 | 41.7494 | 0.06534 |
| Solution 1 | | 44.5632 | 44.5623 | 0.09801 |
| 1 | Solution 1 + APG | 44.7505 | 44.7490 | 1.1634 |
| 2 | Solution 1 + Dequest 2010 | 44.5128 | 44.5113 | 0.1634 |
| 3 | 1 + Benzotriazole + Dequest 2010 | 44.9271 | 44.9260 | 0.1198 |
| 4 | 1 + Tolyltriazole + Dequest 2010 | 44.0679 | 44.0671 | 0.08712 |
| 5 | Solution 1 + Oleyl sarcosine | 44.0477 | 44.0465 | 0.1307 |
| 6 | Solution 1 + A11 | 44.6469 | 44.6467 | 0.0218 |
| $H_2O$ | | 44.0580 | 44.0577 | 0.03267 |

Example 6

This example examines the wicking properties of several lubricating compositions. The wicking test on new milk cartons with Solution 1 was Klenzade test method #28. ½ gallon milk carton (in duplicate) were used. Sani-Glide (0.7%) and water were used as controls.

Solution 1 was run at 0.7% (v) and 0.5% (volume). The results in solutions 1–6 were clearly negative—no dye was found leaking through the milk cartons using the lubricating compositions of the present invention or the related art.

Example 7

This example evaluates corrosion on mild steel using the lubricating compositions identified in Table 6.

Procedure: 1"×3" (2.54×7.62 cm) 1020 mild steel coupons were in 1% Ultrasil™ 390 using a soft scrub powder, and a rinse with DI water and acetone. 200 ml of 0.7% test solutions were placed in 8 oz (0.252 L) jars along with one test coupon for 96 hr. Wi represents the initial weight, Wf represents the formal weight, and MPY represents the mass per year that would have been lost. The capital letters (a and b) indicate repeated tests of the same solutions. This example shows the effect of the addition of corrosion inhibitors to Solution 1 containing no TEA.

TABLE 6

| Lubricating composition | 1 | 2 | 3 |
|---|---|---|---|
| Deionized water | 66.20 | 65.80 | 67.30 |
| A4 | 5.00 | 5.00 | 5.00 |
| A1 | 12.50 | 12.50 | 12.50 |
| Propylene Glycol | 2.00 | 2.00 | 2.00 |
| A10 | 1.50 | 1.50 | 1.50 |
| A9 | 1.00 | 1.00 | 1.00 |
| Tetrasodium EDTA, 40% | 4.00 | 4.00 | 4.00 |
| Triethanolamine | — | — | — |
| A8 | 5.00 | 5.00 | 5.00 |
| Dequest 2010 | 1.00 | 1.00 | — |
| tolyltriazole | | 0.40 | 0.40 |
| NaOH 50% | 1.80* | 1.80* | 1.30* |

*pH adjusted to 5.2–5.3 W/NaOH

| Sample | Description | Wi | Wf | MPY |
|---|---|---|---|---|
| | Sani-Glide | 45.0263 | 45.0258 | 0.05444 |
| | Sani-Glide | 44.3664 | 4.3658 | 0.06534 |
| Example 1 | | | | |
| 1a | Dequest 2010 | 43.7456 | 43.7450 | 0.06534 |
| 1b | | 43.8712 | 43.8695 | 0.1851 |
| Example 2 | | | | |
| 2a | Dequest 2010+ Tolyl Triazole | 44.0691 | 44.0647 | 0.4792 |
| 2b | | 44.0032 | 43.9982 | 0.5445 |
| Example 3 | | | | |
| 3a | Tolyl Triazole | 43.7317 | 43.7313 | 0.04356 |
| 3b | | 44.3025 | 44.3018 | 0.07623 |

Example 8

Solution 8 was prepared by mixing each item listed in Table 7 until each was dissolved and slightly hazy solutions resulted. With the addition of item 8, stirring was for 30 minutes with a slightly hazy solution resulting.

TABLE 7

| Mix Order | Solution 8 | |
|---|---|---|
| 1 | Deionized Water | 64.75 |
| 2 | A4 | 5.00 |
| 3 | A1 | 12.50 |
| 4 | Propylene Glycol | 1.00 |

TABLE 7-continued

| Mix Order | Solution 8 | |
|---|---|---|
| 5 | NaOH 50% | 1.25 |
| 6 | A8 | 5.00 |
| 7 | A9 | 1.00 |
| 8 | A10 | 1.50 |
| 9 | Tetrasodium EDTA, 40% | 5.00 |
| 10 | A11 | 3.00 |
| | | 100% |

This example examines solution 8 compatibility with milk. When solution 8 was diluted with water at various concentrations ranging from about 0.25% to 0.75% by weight and then diluted with milk at ratios of 5:1 to 1:5 by volume, all samples remained homogeneous at 70° F.

Example 9

This example compares the lubricity of solution 7 to RA-1 via slider. The results of this comparison are provided in Table 8.

TABLE 8

| Stainless/ Mild Steel SAMPLE | DILUENT | LUBE USE CONC | FORCE, g | L = 227 g COF | RUN ORDER | Rel COF |
|---|---|---|---|---|---|---|
| FALC | DW | 0.1 | 26.5 | 0.1167 | 1 | 1 |
| Sani-Guide ™ | DW | 0.1 | 22.3 | 0.0982 | 2 | 0.864 |
| | DW | 0.25 | 23 | 0.1013 | 3 | 0.916 |
| | DW | 0.5 | 24.5 | 0.1079 | 4 | 1.004 |
| | DW | 0.75 | 25.8 | 0.1137 | 5 | 1.089 |
| FALC | DW | 0.1 | 23 | 0.1013 | 6 | 1 |
| FALC | DW | 0.1 | 23 | 0.1013 | 1 | 1 |
| Solution 6 | DW | 0.1 | 24.5 | 0.1079 | 2 | 1.065 |
| | DW | 0.25 | 24.5 | 0.1079 | 3 | 1.065 |
| | DW | 0.5 | 24 | 0.1057 | 4 | 1.043 |
| | DW | 0.75 | 24 | 1.1057 | 5 | 1.043 |
| FALC | DW | 0.1 | 23 | 0.1013 | 6 | 1 |
| FALC | DW | 0.1 | 23 | 0.1013 | 1 | 1 |
| RA-1 | DW | 0.1 | 23 | 0.1013 | 2 | 1.004 |
| | DW | 0.25 | 23 | 0.1013 | 3 | 1.009 |
| | DW | 0.5 | 23 | 0.1013 | 4 | 1.013 |
| | DW | 0.75 | 22.5 | 0.0991 | 5 | 0.996 |
| FALC | DW | 0.1 | 22.5 | 0.0991 | 6 | 1 |

As can be seen from these results, all of the lubricating solutions provide an effective level of lubrication.

Example 10

This example compares the erosion stability of solutions 6 and 8. The procedure was the same as that identified above with respect to the previous evaluation of corrosion stability.

| After 96 hr Sample | Description | Wi | Wf | MPY |
|---|---|---|---|---|
| solution 6 | Shown above | 44.1333 | 44.1328 | 0.0545 |
| | | 44.1467 | 44.1463 | 0.0436 |
| solution 8 | Shown above | 44.6338 | 44.6323 | 0.1633 |
| | | 44.0111 | 44.0101 | 0.1089 |
| Sani-Glide ™ | Commercial Product | 44.0842 | 44.0837 | 0.0545 |
| | | 44.1464 | 44.1460 | 0.0436 |

-continued

| After 96 hr Sample | Description | Wi | Wf | MPY |
|---|---|---|---|---|
| $H_2O$ | | 44.1685 | 44.1686 | 0.0109 |
| | | 44.0787 | 44.0629 | 1.7206 |

Example 11

This example evaluates the effects of the lubricating solutions of the invention on surface wear according to the Falex test described below. A8 is a diester of polyethylene glycol (22–25 polyethylene units per molecule) with 5- and 6-carboxy-4-hexyl-2-cyclohexene-1-octanoic acid. The results of this test are reported in Table 9.

TABLE 9

| | SaniGlide | RA-1 | Soln-1 |
|---|---|---|---|
| Deionized Water | | 60.00 | 64.75 |
| A4 | | 5.00 | 5.00 |
| A1 | | 12.50 | 12.50 |
| Propylene Glycol | | 0.00 | 1.00 |
| A10 | | 8.00 | 1.50 |
| A9 | | 0.00 | 1.00 |
| Tetrasodium EDTA, 40% | | 10.00 | 5.00 |
| A11 | | | 3.00 |
| A8 | | | 5.00 |
| A2 | | 2.50 | |
| NaOH 50% | | 2.00 | 1.25 |
| | | 100.00% | 100.00% |
| Teethware @ 0.125%, 45 min 615 lbs., 1137 mild steel | | | |
| Trial 1 | 8 | 6 | 6 |
| Trial 2 | 0 | | 4 |
| Trial 3 | 6 | | |

Falex results do not differentiate Solution-i from RA-1 and the state-of-the art product. However, field test results show that Solution-1 could be run at lower concentration than RA-1 without increasing amperage draw. Therefore, a 0.5% solution of RA-1 proved to be the lower limit while Solution-1 could be run at 0.38% without seeing an increase in amperage draw.

The larger the number shown for amperage draw, the poorer the lubricating ability, and the lower the number, the less amount of wear shown in the example. Solution-I proved to be at least as good as RA-1 and better than the state-of-the-art product. Addition of A8 improves the lubricity and reduces the wear on the contacting surfaces. It is believed that the solutions of the invention benefit from A8, so that solutions containing less than 20% A8, preferably from 01–15%, more preferably from 0.25–10%, and still more preferably from 0.5 to 7.5%, are preferred.

Field testing of Solution-1 on load-bearing, in-floor dairy conveyors showed improved lubricity over RA-1. The concentration of RA-1 was gradually reduced from 0.75% to 0.5%, at which time an increase in amperage draw was detected on the conveyor drive motor. The concentration of Solution-i was reduced to 0.38% without detecting an increase in amperage draw.

This example shows that an extreme pressure additive (in this case, Maxlube 200 which is an exemplary fatty acid diester) provides decreased friction and wear compared to a composition not containing the fatty acid diester. According to the invention, it is believed that the presence of between about 1 wt. % and about 7 wt. % extreme pressure at lubricant can result in at least a 20% reduction in amp draw compared with an otherwise identical composition but not containing the extreme pressure additive.

Testing Procedures

The following procedures were used in the practice of the present invention and referred to as the Falex test. The apparatus used included commercially available friction and wear testing machines available under the name Falex Pin and V-Block. The reagents used were toluene and isopropyl alcohol (IPA).

Sample Preparation: Prepare 2 liters of test lubricant solution in a 4 liter beaker. Test solutions are normally prepared by a wt/wt basis, by weighing the test lubricant to the nearest 0.01 g. Soft water was used when making up the solutions.

Procedure:

Recirculated Falex Lubricity Test

1. Remove 1 clean test pin and 2 clean 'vee' blocks from toluene bath with forceps. It was placed on a lint-free paper towel and wipe the excess toluene off. Avoid touching any part of the mating surfaces (lower ¾ inch of the test pin and any portion of the v-grove on the 'vee' blocks).
2. Place on second lint-free paper towel and spray with IPA. Wipe off excess with lint-free paper towel and air dry using filtered air line hose.
3. Insert test pin into drive shaft and secure with brass shear pin. Place vee blocks into recesses of the loading device and swing the load arms inward to just contact the test pin. Align the 'vee' blocks so that the v-grove is in alignment with the test pin. DO NOT touch the mating surfaces when aligning.
4. Place the load gauge over the load arms and hand turn the ratchet wheel until the 'vee' blocks just contact the test pin (look at torque gauge for first sign of any pressure). Back off ½ turn.
5. Place recirculation cup on support and swing into position under vee blocks holder. Connect recirculation pump.
6. Pour lube solution into the test solution reservoir. Place pump pick-up probe in reservoir and start pump. Flow rate should be 800 ml/min or a reading of 100 on the flow-meter scale. Adjust pump speed accordingly. With the Masterflex pump the motor speed setting is approximately 7 depending on the condition of tubing, this rate may need periodic adjustments.
7. When the lube solution flow has stabilized, start the Falex™ drive motor. Place the ratchet arm on the ratchet wheel and advance slowly until it advances on its own. Allow it to advance until the load gauge reads 300 pounds. Remove ratchet arm from ratchet wheel.
8. Start 5 minute timer. Record initial warm up torque (in pounds). Maintain 300 pound load.
9. At the end of the 5-minute warm up period, record the final warm up torque (in pounds).
10. Replace ratchet arm on ratchet wheel and advance until gauge reads 615 pounds. Remove ratchet arm. NOTE: If the test fails (pin and vee blocks weld together) at any point, the time was recorded or the pounds reached were recorded when failure occurred and the test was stopped immediately.
11. Start 15-minute timer. Record initial torque. Place 1"×3" metal coupon on load arms, then read and record the tooth number from the ratchet wheel.
12. Maintain load gauge at 615 pounds by engaging the ratchet arm when the load drops below 615 pounds.

13. Record the torque every 2.5 minutes.
14. At the end of 45-minute test, record the final torque and the final tooth number. Turn off Falex™, then drive the motor and the recirculation pump. Run recirculation pump in reverse until lines are completely flushed out.
15. Remove recirculation cup and discard solution. Discard reservoir solution. Remove test pin and 'vee' blocks from their holders. Examine test pin and vee blocks for wear and any build up of material. Place test pin and 'vee' blocks in small, labeled, poly bags.
16. Spray Falex™ 'vee' block holders and test pin holder with isopropyl alcohol. Air blow-dry all surfaces.

METAL CORROSION TEST

This test method is based upon an accepted, but not exclusive, procedure for metal corrosion testing as outlined in the American Society for Testing and Materials (ASTM), Volume 3.02, G31–72 and 3.02, G1–90.

Metal strips are pre-cleaned, weighed, and put into glass bottles with 200 ml of 0.7% product solution and placed at 22° C. After the specified time, the corroded metal strips are then cleaned, weighed, and weight loss is determined. Corrosion rates are directly proportional to the mass loss of the metal strip and inversely proportional to the strip area, density, and time of exposure to the test solution.

METAL STRIP PREPARATION—PRE-CLEANING

1. Identify each metal strip by using steel stencil stamp. Prepare at least duplicates per test condition and metal type, and duplicate controls per metal type being tested.
2. Pre-clean all metal strips.
3. 1 inch by 3 inch coupons (2.54 by 7.62 cm) cold rolled steel (1020) were cleaned using a 1% solution of Ultrasil 390 (alkaline cleanser) and a non-abrasive scrubbing pad.
4. Rinse metal strips with distilled water followed with an acetone rinse.
5. Let metal strips air dry. Store strips in desiccator until used.
6. Weigh the clean, dry, metal strips and controls (Wi) on an analytical balance.

TEST CONDITIONS

1. Temperature of testing is generally ambient (22° C.).
2. Label containers. The standard container is an 8 ounce, wide-mouth glass jar. Test metal strips should be supported in the standard container so that the metal strip is no less than 45 degrees relative to the horizontal plane. Glass panels are inserted vertically in the standard container as a support with the metal strip resting against it with as little contact as possible to obtain this angle.
3. 0.7% test concentrations were used on a percent by weight basis.
4. One coupon per jar was fully immersed in 200 ml of test solution for 96 hours.
5. At the end of the test time, the metal strips were removed from the container and rinse with distilled water.

CLEANING METAL STRIPS AFTER TEST—POST-CLEANING

1. The metal strips are cleaned as noted above and then air-dried. The metal strips were then analytically weighed (Wf).

CALCULATIONS

The total weight loss (TWL) for each test strip is calculated by subtracting the post- cleaning weight (Wf) of the strip from the precleaning weight (Wi) of the strip. The corrosion rate in mils per year (mpy) for each strip is calculated as:

$$mpy=(534{,}000*TWL)/(A*T*D)$$

wherein A=area of the entire strip in square inches (calculating for all 6 sides of the strip, the two major faces and the four edge faces)

T=Time exposure (hours)

D=Metal density ($g/^{cm}$)

SLIDER LUBRICITY METHOD

The friction properties were measured on a slider in the following manner. Samples for lubricity were diluted to the appropriate concentration with deionized water and streamed along the perimeter of a polished stainless steel plate measuring 20.5 cm in diameter. The plate was rotated by an electric motor at a steady speed. A mild steel disk weighing 228 grams was attached to a load cell and placed on the plate in the area wetted by the lubricant solution. When the electric motor was activated, the disk glided freely on the plate. The drag force between the glass or mild steel was detected by the load cell and transferred to a chart recorder.

To assure consistency of the test method, the drag from a standard fatty acid lubricant solution was measured before and after each test lube, and the value obtained therefrom arbitrarily assigned a coefficient of friction of 1.00 as a relative standard for the test. Each trail run was referenced to the fatty acid lubricant trials. The results were therefore reported as a relative coefficient of friction (COF). The lower the COF, the better the lubricity. The fatty acid lubricant control (FALC) is available under the name LubriKlenz LF from Ecolab Inc.

What we claim is:

1. An antimicrobial conveyor lubricant composition comprising:

a) alkyl alkoxylated phosphate ester;

b) alkyl quaternary ammonium antimicrobial agent;

c) extreme pressure additive;

d) water; and e) neutralizing agent in an amount sufficient to provide an antimicrobial lubricant composition use solution with a pH in the range of about 4 to about 9;

wherein the lubricant composition contains less than 1 wt. % fatty acid having a $C_{6-24}$ carbon chain and the ratio of phosphate ester to quaternary ammonium antimicrobial agent is at least 1.5:1.

2. An antimicrobial conveyor lubricant composition according to claim 1, further comprising:

a) secondary alcohol alkoxylate.

3. An antimicrobial conveyor lubricant composition according to claim 1, wherein the alkyl alkoxylated phosphate ester is provided in an amount of between about 1 wt. % and about 20 wt. %.

4. An antimicrobial conveyor lubricant composition according to claim 1, wherein the alkyl alkoxylated phosphate ester has the general structural formula:

$$R^1—O—(R^2O)_n—PO_3X_2$$

wherein $R^1$ comprises an alkyl group of from 1 to 20 carbon atoms, $R^2$ is selected from —$CH_2$—$CH_2$— and

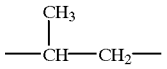

n is 3 to 8 when $R^2$ is propylene, and 3 to 10 when $R^2$ is ethylene, and

X is hydrogen, alkanolamine and/or alkali metal.

5. An antimicrobial conveyor lubricant composition according to claim 1, wherein the quaternary ammonium antimicrobial agent is provided in an amount of between about 0.25 wt. % and about 10 wt. %.

6. An antimicrobial conveyor lubricant composition according to claim 1, wherein the extreme pressure additive is provided in an amount of between about 0.5 wt.% and about 10 wt.%.

7. An antimicrobial conveyor lubricant composition according to claim 1, wherein the extreme pressure additive comprises at least one of fatty acid diesters, sulfonated fatty acid esters, linear alcohols, and mixtures thereof.

8. An antimicrobial conveyor lubricant composition according to claim 1, wherein the water is provided in an amount of between about 5 wt. % and about 95 wt. %.

9. An antimicrobial conveyor lubricant composition according to claim 1, wherein the neutralizing agent comprises at least one of alkali metal hydroxide, ammonium salt, amine, and mixtures thereof.

10. An antimicrobial conveyor lubricant composition according to claim 2, wherein the secondary alcohol alkoxylate is provided in an amount of between about 0.1 wt. % and about 8 wt. %.

11. An antimicrobial conveyor lubricant composition according to claim 2, wherein the secondary alcohol alkoxylate comprises the following formula:

$$R^3—O—(R^4O)_n—H$$

wherein $R^3$ comprises a secondary alcohol group containing 10 to 20 carbon atoms, $R^4$ comprises ethylene and/or propylene, and n is 3 to 8 when $R^4$ is propylene, and is 3 to 12 when $R^4$ is ethylene, and is 3 to 10 when $R^4$ is a mixture of ethylene and/or propylene.

12. An antimicrobial conveyor lubricant composition according to claim 2, wherein the weight of the alkyl alkoxylated phosphate ester and said secondary alcohol alkoxylate to the antimicrobial agent is between 1.5:1 to 10.0:1.

13. An antimicrobial conveyor lubricant composition according to claim 2, wherein the weight ratio of the alkyl alkoxylated phosphate ester and secondary alcohol alkoxylate to the antimicrobial agent is between 2.0:1 and 10.0:1.

14. An antimicrobial conveyor lubricant composition according to claim 1, further comprising:

(a) at least one of monoethanolamine and diethanolamine.

15. An antimicrobial conveyor lubricant composition according to claim 1, further comprising:

a corrosion inhibitor.

16. An antimicrobial conveyor lubricant composition according to claim 15, wherein the corrosion inhibitor comprises a triazole.

17. An antimicrobial conveyor lubricant composition according to claim 16, wherein the triazole has an aromatic substituent.

18. An antimicrobial conveyor lubricant composition according to claim 17, wherein the triazole is selected from the group consisting of benzotriazole and tolyltriazole.

19. An antimicrobial conveyor lubricant composition according to claim 1, further comprising:

0.1 wt. % to 1 wt. % propylene glycol.

20. An antimicrobial conveyor lubricant composition according to claim 1, wherein the composition is diluted with water to provide a use solution having an active level of about 0.1 wt. % to about 1 wt. %.

21. An antimicrobial conveyor lubricant composition according to claim 1, wherein the composition is provided as a concentrate containing water in an amount of between about 5 wt. % and about 95 wt. %.

22. An antimicrobial conveyor lubricant composition according to claim 1, further comprising:

(a) an organic phosphonic acid containing chelating agent.

23. An antimicrobial conveyor lubricant composition according to claim 1, wherein the extreme pressure additive comprises a 22–25 mole polyethylene glycol diester of the mixture of 5- and 6-carboxy-4-hexyl-2-cyclohexene-1-octanoic acid.

24. A method for using an antimicrobial conveyor lubricant composition, the method comprising a step of:

(a) applying an antimicrobial conveyor lubricant composition use solution to a conveyor, the antimicrobial conveyor lubricant composition comprising:

(i) alkyl alkoxylated phosphate esters;

(ii) alkyl quaternary ammonium antimicrobial agent;

(iii) extreme pressure additive;

(iv)water; and (v) neutralizing agent in an amount sufficient to provide the antimicrobial lubricant composition with a pH in the range of about 4 to about 9;

wherein the antimicrobial conveyor lubricant composition contains less than 1 wt. % fatty acid lubricant and the ratio of phosphate ester to quaternary ammonium antimicrobial agent is at least 1.5:1.

25. A method according to claim 24, further comprising a step of:

(a) diluting the antimicrobial conveyor lubricant composition with water to provide a use solution containing an active level of between about 0.1% and 1%.

26. A method according to claim 24, wherein the antimicrobial conveyor lubricant composition further comprises a corrosion inhibitor.

27. An antimicrobial conveyor lubricant composition according to claim 1, wherein the ratio of phosphate ester to quaternary ammonium antimicrobial agent is between 2.0:1 to 10.0:1.

28. An antimicrobial conveyor lubricant composition according to claim 1, wherein the ratio of phosphate ester to quaternary ammonium antimicrobial agent is between 2.0:1 to 8.0:1.

29. An antimicrobial conveyor lubricant composition according to claim 4, wherein $R^1$ comprises a linear alkyl group.

30. An antimicrobial conveyor lubricant composition according to claim 4, wherein $R^1$ comprises a branched alkyl group.

31. An antimicrobial conveyor lubricant composition according to claim 4, wherein $R^1$ comprises a cyclic alkyl group.

32. An antimicrobial conveyor lubricant composition according to claim 4, wherein $R^1$ comprises an alkyl group containing from 8 to 12 carbon atoms.

33. A method according to claim 24, wherein the ratio of phosphate ester to quaternary ammonium antimicrobial agent is between 2.0:1 to 10.0:1.

34. A method according to claim 24, wherein the ratio of phosphate ester to quaternary ammonium antimicrobial agent is between 2.0:1 to 8.0:1.

* * * * *